United States Patent [19]

Taylor

[11] 4,052,027

[45] Oct. 4, 1977

[54] METHOD AND MEANS FOR SECURING RAILROAD CARS TO A BARGE DECK

[76] Inventor: Edward R. Taylor, #6-6750 Dow Ave., Burnaby, British Columbia, Canada, V5H 3G9

[21] Appl. No.: 625,715

[22] Filed: Oct. 24, 1975

[30] Foreign Application Priority Data

Nov. 28, 1974 Canada ..... 214847

[51] Int. Cl.[2] ..... B60P 7/00

[52] U.S. Cl. ..... 248/119 R; 105/368 T; 105/473; 248/499; 254/67

[58] Field of Search ..... 59/86; 114/72, 73, 75, 114/70; 105/368 B, 368 T, 463, 464, 466, 473, 486; 254/67; 248/119 R, 119 S, 25, 499; 280/179 R, 179 A, 179 B; 294/118

[56] References Cited

U.S. PATENT DOCUMENTS

| | | | |
|---|---|---|---|
| 737,846 | 9/1903 | Jennings | 280/179 A UX |
| 1,037,615 | 9/1912 | Grenier | 254/67 |
| 1,172,915 | 2/1916 | Stevens | 294/118 |
| 2,024,444 | 12/1935 | Friedlaender | 248/119 R |
| 2,715,012 | 8/1955 | Huber | 254/67 |
| 2,847,207 | 8/1958 | Chulack et al. | 105/463 X |
| 2,869,255 | 1/1959 | Page | 59/86 X |
| 3,140,850 | 7/1964 | Packard | 105/368 T X |
| 3,338,359 | 8/1967 | Baillie et al. | 254/67 X |
| 3,724,151 | 4/1973 | Kaywood et al. | 105/473 X |

FOREIGN PATENT DOCUMENTS

| | | | |
|---|---|---|---|
| 69,671 | 10/1945 | Norway | 294/118 |
| 4,128 of | 1885 | United Kingdom | 59/86 |
| 186,302 | 1/1967 | U.S.S.R. | 114/70 |

OTHER PUBLICATIONS

"What's New in Products", Railway Age, Feb. 14, 1955, p. 29.

*Primary Examiner*—Lawrence J. Staab
*Attorney, Agent, or Firm*—Fetherstonhaugh and Company

[57] ABSTRACT

A tie-down device is provided having a turnbuckle-like tensioning member operated by a hand-cranked ratchet lever. One end of this member is connected by a pair of levers to a pair of jaws arranged to function as tongs to grip a railroad car part. The opposite end of the member has a double shackle arrangement allowing the device to be releasably attached to a surface-supported anchor member. A method of employing such devices to secure railway cars to the deck of a barge.

3 Claims, 3 Drawing Figures

METHOD AND MEANS FOR SECURING RAILROAD CARS TO A BARGE DECK

Figure 1:
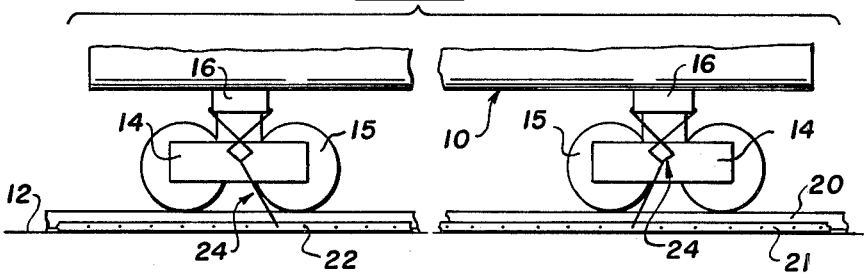

My invention relates to means and a method particularly intended for use in securing railroad cars to the deck of a barge.

When railroad cars are being transported by barge, it is extremely important that the cars be lashed down securely in case rough weather is encountered. The procedure normally followed when loading railroad cars onto a barge is to push the coupled car into position on the deck and then to secure the cars so that little movement as possible will take place during the voyage. This is extremely difficult to do with this type of deck cargo since there is quite a strong tendency for the cars to roll back and forth as the barge pitches and rolls during the voyage even though all the car brakes are applied. In addition, there is a certain amount of play in the car couplings and the cars themselves are spring mounted so that some movement generally takes place when conventional lashings are used and wind or choppy seas are met during the voyage. It is this movement, slight as it may be, which has been found to be the cause of failure of the lashings themselves or failure of the special brackets or the like which must be provided on the car to attach the lashings. Once a single lashing chain or securing bracket fails, an even greater strain is imposed upon adjacent brackets and fasteners until these too fail. Whenever a car becomes loose, both the cargo and vessel are in danger of being damaged or lost.

My invention solves this problem of holding railroad cars in position on deck by providing means for removing nearly all free play from the lengths of coupled cars and from the individual cars by compressing their springs so that the car bodies cannot sway relative to the wheels on which they ride. The lashings or tensioning devices of the invention are capable of gripping an existing part of the car without the need for special brackets and they apply a clamping force to that part which is proportionate to the tension applied.

Apparatus according to the present invention may be defined as a tie-down device for securing the corner of a railroad car to a supporting surface having anchor members alongside rails on which the car is adapted to roll, comprising a tension-applying member having opposite ends, a pair of clamping jaws pivotally connected together and having opposing free ends engageable with a part of the car, lever means operatively connecting opposite ends of the clamping jaws to one end of the tension-applying member, securing means on the other end of the tension-applying member for releasably attaching said member to the anchor member, an operating means on the tension-applying member whereby said member can be contracted to clamp the box car part between the jaws.

A method of using such apparatus according to the present invention comprises the steps of securing each of the four corners of the car to an anchor member by means of a tie-down device with each of said devices inclined at an angle opposite to the angle of inclination of a tie-down device at the other corner and on the same side of the car, and applying tension by tightening the tie-down devices on the four corners of the car whereby to compress springs at opposite ends of said car.

Figure 2:
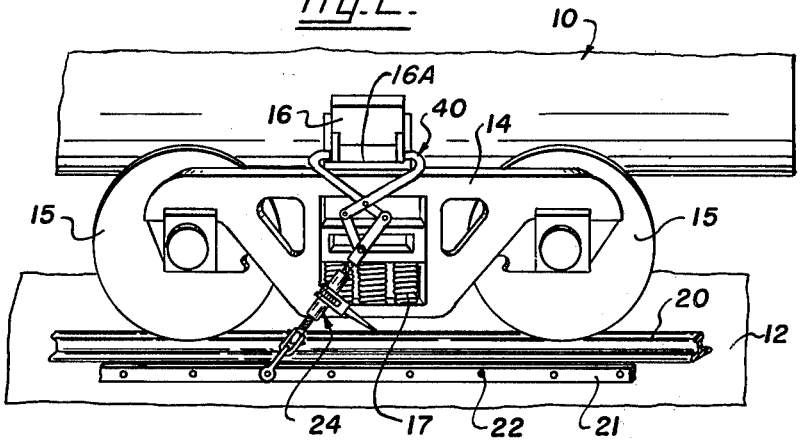
Figure 3:
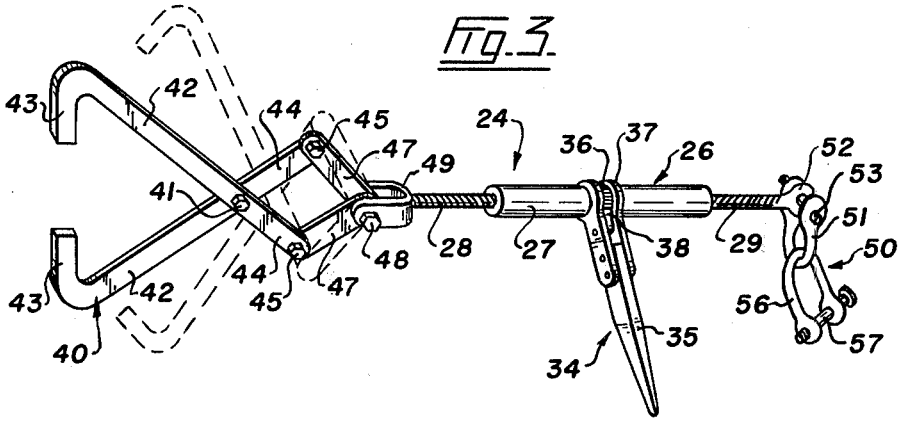

In drawings which illustrate a preferred embodiment of the invention,

FIG. 1 is a schematic view, part broken away, showing a railroad car lashed to the deck of a barge by a tie-down device constructed in accordance with the present invention, FIG. 2 is a prospective view, showing in detail, one corner of the car held by the tie-down device, and FIG. 3 is a detailed prospective view of the tie-down device.

As shown schematically in FIG. 1, and in greater detail in FIG. 2, a typical use for the present invention is to secure a tank car 10 to a barge deck 12. Such a car is provided near each end with a side frames 14 which journal wheels 15 and each frame includes a cross member 16 the ends of which project laterally a short distance beyond the remainder of the frame. The weight of the tank is cushioned by heavy compression springs 17 mounted in the frames. The deck 12 of a barge designed to carry railroad cars is provided with rails 20 along which the wheels 15 can roll and secured to the deck alongside these rails are suitable anchor members 21. Members 21 normally take the form of rail-like bars which are firmly fastened to the deck parallel to and alongside the rails, the bars having regularly spaced transverse holes 22 along their entire length.

As shown best in FIG. 3, a tie-down device is generally indicated at 24 and will be seen to comprise a tension-applying member 26. This turnbuckle-like member 26 has an internally threaded sleeve 27 and fitted to this sleeve so as to project from opposite ends thereof are left and right hand threaded rods 28 and 29.

Sleeve 27 is adapted to be rotated with respect to the rods 28 and 29 by means generally indicated at 34. The operating means 34 comprises a laterally projecting lever 35 which is rotatably mounted on the center of the sleeve and a ratchet wheel 36 is secured to the sleeve between a forked inner end 37 of this lever. A pawl 38 carried by the lever 35 engages the wheel 36 whereby the sleeve 27 can be rotated in either direction by cranking the lever after appropriately adjusting the pawl. When the rods 28 and 29 are held against rotation and the sleeve is turned in one direction, the member 26 is contracted while rotation of the sleeve 27 in the opposite direction will extend the length of this tension-applying member.

This extension and contraction of the member 24 serves to open and close a pair of crossed jaws 40 which are connected at their intersection by a pivot bolt 41. The tong-like jaws 40 have long portions 42 and ends 43 of these portions are inwardly turned to oppose one another. Relatively short portions 44 of the jaws 40 are each fitted with a pivot bolt 45. An angularly disposed pair of levers 47 are pivotally connected to the jaws by the bolts 45 and the crossed ends of these levers in turn are pivotally connected by a bolt 48 to a U-shaped yoke 49 which is non-rotatably secured to the projecting end of the rod 28. The levers 47 which diverge from the bolt 48 are slightly longer than the jaw portions 44 which converge towards the bolt 41 and these jaw portions are considerably shorter than the jaw portions 42. This arrangement provides the device 24 with the mechanical advantage needed to apply the tremendous clamping force which is required to hold a railroad car in place as will be described later.

The device 24 is adapted to be anchored to a fixed object by securing means generally indicated at 50. As best shown in FIG. 3, means 50 will be seen to comprise a shackle 51 which is secured to an eye 52 on the projecting end of the rod 29 by means of a pin 53 disposed at right angles to the longitudinal axis of said rod. Mounted on the shackle 51 is another shackle 56 fitted with a removable pin 57.

The preferred loading procedure when the present invention is employed is to roll the coupled lengths of cars onto the barge deck with the placement of the side-by-side lengths being such as to ensure proper trim of the vessel. Wheel chocks, not shown, are secured in position at the forward end of each length of cars and the stern end of said length is similarly held by means of other chocks, also not shown. This arrangement of chocks and the application of the brakes of the individual cars helps to prevent fore and aft movement of the car lengths but, since slack exists in the car couplings and the cars are spring mounted, each car must be separately secured against movement.

Four of the devices 24 are used to secure each car 10 to the barge deck, there being two such devices on each side of the tank or box car body. Preferably, this is done by placing the opposing ends 43 of the jaws on the horizontal flanges 16A which project from opposite sides of the cross members 16. The considerable weight of the strongly constructed tie-down device is sufficient to cause the jaws 40 to firmly grip the member 16 with the device then being freely suspended therebelow. Each device 24 is then swung at an acute angle to the vertical and is secured to the anchor members 21 by first removing the pin 57 from the shackle 56 and then positioning this shackle so that it straddles the anchor member. When the pin 57 is replaced in the shackle so as to project through a selected one of the holes 22, the device is properly attached to the anchor member by the securing means 50.

The devices are secured to the cross members 16 and to the anchor rails 18 preferably at the relative angles shown in FIGS. 1 and 2. FIG. 1 shows the relative angles of the two devices located on one side of the car and the devices on the opposite side are angled in the same manner. Of course, the devices 24 may be disposed so as to extend from the members 16 towards the adjacent ends of the cars instead of being angled in the manner shown in FIG. 1. As long as the devices on each side of a car are at opposite angles, the same holding action is achieved.

After each device 24 is hung on an end of a member 16, is angled as described, and is then attached to the anchor member 21; an appropriate amount of tension is applied by actuation of the lever 35 to fully compress the springs 17 of the railway cars. This, of course, is done on all four corners of the car whereupon the tank or other body of the car cannot move relative to the wheels 15 and the coupled cars are likewise held against movement along the rails 20 and with respect to one another.

From the foregoing, it will be apparent the box car is lashed down so that it cannot move or sway even in the roughest weather. The tie-down devices can be installed quickly and can and, of course, can be removed in the same manner to free the cars at the end of a voyage. There is no need to weld or otherwise secure special fittings to the cars to provide a point of attachment for the devices since the existing cross members 16 cann readily serve this purpose due to the clamping action which is achieved by the jaws as they are closed through the mechanical advantage provided by the levers.

I claim:

1. A tie-down device particularly adapted for use in securing a corner of a railroad car to a supporting surface having anchor members alongside the rails on which the car is adapted to roll, comprising:

a pair of clamping arms pivotally connected together intermediate their ends, having clamping jaws at their outer ends which are turned towards each other, and each clamping arm pivotally connected at its inner end to a lever arm, said lever arms being shorter than said clamping arms and being pivotally connected to each other and to one end of a rod means, said pair of clamping arms being pivotally connected together by a pivot means located nearer to its inner ends than its outer ends, the opposite end of said rod means including securing means for releasably connecting that end to an anchor member, said rod means including a tension applying means along its length including a pair of aligned and separate oppositely threaded portions, an internally threaded sleeve threadedly engaged with both of said threaded portions, such that turning of the sleeve about its axis moves the threaded portions towards and away from each other, and a manually operated ratchet lever engaged with the sleeve such that turning of the lever in one direction shortens the rod means to tighten the tie-down device and to apply a clamping force of the clamping jaws towards each other proportional to the applied tension.

2. A tie-down device as claimed in claim 1 in which said securing means comprises a first shackle pivotally secured to the tension-applying member by a first pin, and a second shackle swingably engaging the first shackle and having a removable second pin disposed substantially at right angles to the first pin and adapted to project through a hole in the anchor member.

3. A method of loading and securing a spring-equipped railroad car to a barge fitted with anchor members, comprising the steps of securing each of the four corners of the car to an anchor member by means of a tie-down device with each of said devices inclined at an angle opposite to the angle of inclination of a tie-down device at the other corner and on the same side of the car, wherein each of the tie-down devices includes a pair of clamping arms pivotally connected together intermediate their ends, having clamping jaws at their outer ends which are turned towards each other, and each clamping arm pivotally connected at its inner end to a lever arm, the lever arms being shorter than the clamping arms and being pivotally connected to each other and to one end of a rod means, the opposite end of said rod means being releasably connectable to the anchor members, the rod means including a tension applying means along its length including a pair of aligned and separate oppositely threaded portions, an internally threaded sleeve threadedly engaged with both of the threaded portions, such that turning of the sleeve about its axis moves the threaded portions towards and away from each other, and a manually operated ratchet lever engaged with the sleeve such that turning of the lever in one direction shortens the rod means to tighten the tie-down device, and applying tension by tightening the tie-down devices of each box car by operating the ratchet lever such that the clamping force at the clamping jaws is proportional to the tensioning force applied at the ratchet lever and continuing the application of tension until the springs at opposite ends of said car are compressed.

* * * * *